US005760810A

United States Patent [19]

Onodaka

[11] Patent Number: 5,760,810

[45] Date of Patent: Jun. 2, 1998

[54] FIELD EMISSION PRINT HEAD

[75] Inventor: Koji Onodaka, Mobara, Japan

[73] Assignee: Futaba Denshi Kogyo K.K., Mobara, Japan

[21] Appl. No.: 659,823

[22] Filed: Jun. 7, 1996

[51] Int. Cl.[6] ..... B41J 2/415

[52] U.S. Cl. ..... 347/123

[58] Field of Search ..... 347/121, 122, 347/127, 128, 237, 238; 315/167, 169.1; 313/446, 447, 448, 309, 336, 495; 361/777; 445/24, 50

[56] References Cited

U.S. PATENT DOCUMENTS 5,402,157 3/1995 Nagato et al. ..... 347/122

*Primary Examiner*—Benjamin R. Fuller
*Assistant Examiner*—L. Anderson
*Attorney, Agent, or Firm*—Oblon, Spivak, McClelland, Maier & Neustadt, P.C.

[57] ABSTRACT

Odd-order patch-like gate electrodes are, by gate lead lines, connected to a first electrode, even-order patch-like gate electrodes are, by gate lead lines, connected to a second gate electrode. The first and second gate electrodes are selectively and alternately operated. By making the potential of gate electrodes, which are not being selected, to be a low level, the patch-like gate electrodes, which are being operated, can be surrounded by low-level conductors. Thus, electrons emitted from the patch-like gate electrodes can be converged.

7 Claims, 6 Drawing Sheets

FIRST SHIFT REGISTER
FIRST INFORMATION-SIDE DRIVER
SECOND INFORMATION-SIDE DRIVER
SECOND SHIFT REGISTER
SCAN SIDE DRIVER
SHIFT CLOCK
IMAGE DATA
LATCH 1
OUTPUT ENABLE
OUTPUT ENABLE
LATCH 2
IMAGE DATA
SHIFT CLOCK
SCAN SWITCHING PULSE
GT2
GT1
C1
C3
C5
C(n-1)
C2
C4
C6
Cn
10
11
12
13
14
15

FIELD EMISSION PRINT HEAD

BACKGROUND OF THE INVENTION

1. Field of the Invention

The present invention relates to a print head for an optical printer, and more particularly to a print head using a field emission device.

2. Related Art

Hitherto, optical printers have been known. The schematic structure of the optical printer will now be described with reference to FIG. 1. A film 120 is coated with a sensitive material, such as silver halide (silver salt), so as to be exposed to light when the lower surface of the film 120 is irradiated with light reflected by a mirror 121.

The film 120 is irradiated with light emitted from a print head 125. The print head 125 is supplied with image data for each line. Light modulated by image data above is main scanned vertically on the surface of paper and the print head 125 is sub-scanned as indicated by an arrow shown in FIG. 1 so that one image is printed on the film 120 by a line sequential method.

Reference numeral SLA 122 represents a SELFOC lens array serving as a lens for causing light emitted from the print head 125 to be focused on the surface of the film 120. A mirror 123 introduces light into the SLA 122.

An RGB filter 124 is an optical filter of three primary colors for printing a color image on the film 120. In a case where a color image is printed, image data for one line is decomposed into R, G and B image data, and then the RGB filter 124 is moved to correspond to image data for each color so that the RGB filter 124 performs the main scanning operations. That is, the main scanning operations performed by three times result in the color image for one line being displayed on the film 120.

An optical printer of the foregoing type has a light source which has been a light emitting diode (LED) or a fluorescent character display tube of a thermionic emission type. In recent years, use of a semiconductor microprocessing technique has enabled micron size field emission devices to be formed into an array configuration on a substrate. A field emission print head using the foregoing field omission device array as the electron source has been suggested (refer to Japanese Patent Laid-Open No. 4-43539).

An example of the structure of a conventional field emission print head of the foregoing type is shown in FIG. 2. In FIG. 2, FIG. 2A is a schematic plan view, FIG. 2B is a schematic cross sectional view taken along line IIB—IIB shown in FIG. 2A, and FIG. 2C is a detailed cross sectional view taken along line IIC—IIC shown in FIG. 2A. As shown in FIG. 2, the field emission print head has a first flat substrate 101 having a plurality of field emission devices 105 formed thereon, a second flat substrate 102 disposed opposite to the first flat substrate 101 and having a fluorescent member 106 and so forth formed thereon, a holder member 103, for maintaining a predetermined distance from the first flat substrate 101 to the second flat substrate 102, and a vacuum layer 104 surrounded by the first flat substrate 101, the second flat substrate 102 and the holder member 103.

The first flat substrate 101 is made of an n-type silicon single crystal substrate and covered with a silicon oxide film (SiO2 film) 101' except at the field emission devices 105 and the substrate contact electrode 107 thereof. The second flat substrate 102 is made of a transparent glass substrate and having a transparent anode electrode 109 and a fluorescent member 106 laminated on the surface thereof. The field emission devices 105, each having a cathode electrode and a gate electrode, and the fluorescent member 106, having an anode electrode, are disposed opposite to each other in such a manner that a vacuum layer 104 is formed between the field emission devices 105 and the fluorescent member 106. A pair of the field emission devices 105 and the fluorescent member 106 form a unit light source. Each unit light source has one field emission device sectioned by gate electrodes separated from one another and disposed in the form of an array. The cathode electrode of each of the field emission devices shares a monocrystal silicon plate. Also the anode electrode is commonly shared.

One field emission device, as shown in FIG. 2C, has a plurality of projecting cathode electrodes (emitters) 111 formed on the surface of the first flat substrate 101 and gate electrodes 112 formed on the SiO2 film 101' and having openings adjacent to the foregoing projections. The gate electrodes are separated from one another by each field emission device.

Although the first flat substrate 101 is made of the single crystal silicon substrate and the projections are formed by anisotropic etching of the single crystal silicon substrate, an insulating substrate having metal electrodes and metal projections may be employed or a structure having metal projections formed on a conductive substrate may be employed.

In the thus-structured unit light source in a state where the single crystal silicon substrate 101 is grounded through the substrate contact electrode 107, when anode voltage Vak is applied to the fluorescent member 106 through the anode contact electrode 110 and the anode electrode 109 and gate voltage Vgk is applied to the gate electrode of the field emission devices 105 through the gate contact electrode 108, the electric field of the gate electrode is applied to the projection portions of the cathode electrode of the field emission devices 105 so that electrons are field-emitted from the leading portions of the projections. The field-emitted electrons are accelerated due to the anode voltage when allowed to reach the fluorescent member 106 so that the portions of the fluorescent member 106 opposite to the device emit light.

Thus-emitted light passes through the transparent anode electrode 109 and the second flat substrate 102 so that image data for one line is emission-recorded on a recording medium, such as a film. In the foregoing case, the line sequential scan method may be employed as described above, in which the recording medium or the print head is moved to record image data for the following one line.

Since a field emission print head of the foregoing type is manufactured by using the microprocessing technique for semiconductors, high resolutions can be realized.

However, in the foregoing conventional field emission print head, electrons are emitted from the leading ends of the projecting cathode electrodes 111 for field-emitting electrons while being spread by an angular degree of about 60 degrees. Therefore, somewhat spread electrons reach the anode electrode 109. As a result, there is a risk that adjacent pixels on the anode electrode 109 are excited to emit light. Thus, there arises a problem in that the resolution deteriorates and a high quality image cannot be printed due to leakage emission. In a case where the anode electrode 109 is in the form of a patterned flat and solid electrode, the foregoing problems become more critical.

SUMMARY OF THE INVENTION

Accordingly, an object of the present invention is to provide a field emission print head capable of converging field-emitted electrons.

To achieve the foregoing object, according to one aspect of the present invention, there is provided a field emission print head comprising: a plurality of cathode lines formed on a cathode substrate; a plurality of emitters formed on the cathode lines; patch-like gate electrodes formed on the cathode substrate through an insulating layer at positions opposite to the cathode lines, the patch-like gate electrodes being disposed adjacent to leading ends of the plural emitters; and an anode substrate disposed opposite to the cathode substrate and including an anode line pattern having a fluorescent layer applied to portions opposite to the patch-like gate electrodes, wherein two zigzag lines of the patch-like gate electrodes are disposed, two gate lines are formed on the outsides of the two lines of the patch-like gate electrodes, gate lead lines individually drawn from the patch-like gate electrodes in the line consisting of every other patch-like gate electrodes are allowed to pass between the patch-like gate electrodes forming other lines consisting of residual patch-like gate electrodes so as to be connected to the gate line disposed apart from the patch-like gate electrodes from which the gate lead lines are drawn.

According to another aspect of the present invention, the field emission print head has a structure such that the gate lead lines are formed into a shape which surrounds the patch-like gate electrodes that form the line to which the gate lead lines are not connected.

Moreover, a structure may be employed in which the anode line pattern has two zigzag lines of patch-like anode electrodes formed opposite to the two zigzag lines of the patch-like gate electrodes and two anode lines to each of which the patch-like anode electrode forming the line is connected, the patch-like anode electrodes are covered with the fluorescent layer so that light emission of each opposite line of the patch-like gate electrodes and the patch-like anode electrodes is controlled to alternately emit light in about ½ period in a display period for one line, and potential of the gate lines and the anode lines forming the line controlled not to emit light is made to be a low level.

Moreover, a structure may be employed in which the anode line pattern has patch-like anode electrodes formed substantially in a straight line to be opposite to the two zigzag lines of the patch-like gate electrodes and two anode lines to which every other patch-like anode electrodes are connected, and the fluorescent layer covering the patch-like anode electrodes formed in a straight line displays one line of display data.

According to the present invention, each of the gate lead lines connected to any one of two lines of the patch-like gate electrodes is connected to either of two gate lines alternately drawn from portions between every other patch-like gate electrode. In the foregoing case, the two gate lines are alternately selected and operated. By making the potential of the gate line, which is not being selected and operated, to be a low level (may be zero level or a negative level), electrons, which are field-emitted from each patch-like gate electrode, do not diffuse but converge. In the foregoing case, the structure such that the patch-like gate electrodes are surrounded by the gate lead lines for the other lines will improve the obtainable advantage.

When two anode lines are provided to correspond to the two gate lines and the potential of the anode lines of the lines opposite to the gate lines, which are not being selected and operated, are made to be a low level (may be zero level or a negative level), electrons can further be converged when allowed to reach the fluorescent layer covering the anode lines.

Therefore, leakage emission of adjacent pixels can further be prevented so that a high quality printed image is obtained.

Since the electric field generated from the non-selected gate line acts to eliminate the influence of the state of selection of other pixels positioned in the vicinity of the selected pixel on, undesirable change in the light quantity can be prevented regardless of the state where the adjacent pixels are turned on.

Other objects, features and advantages of the invention will be evident from the following detailed description of the preferred embodiments described in conjunction with the attached drawings.

DETAILED DESCRIPTION OF THE PREFERRED EMBODIMENTS

Figure 3A:
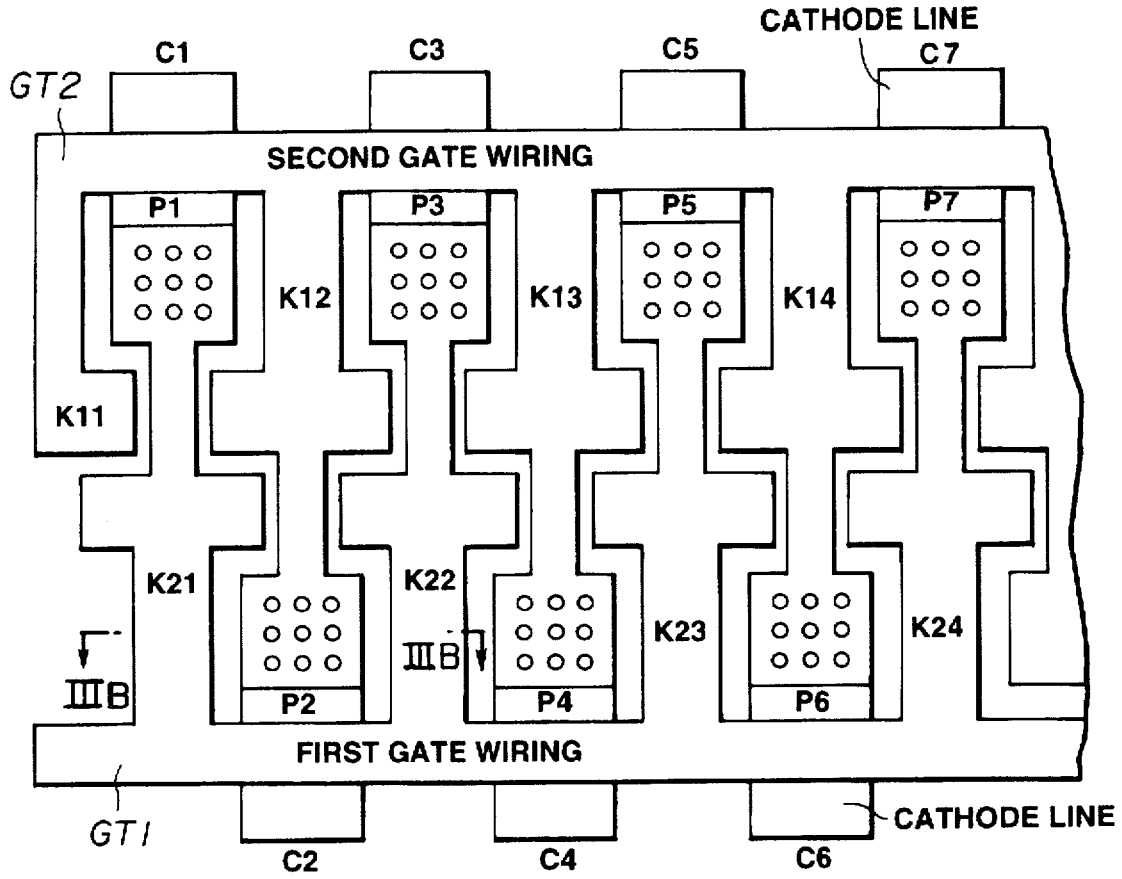
FIGS. 3(*a*) and 3(*b*) respectively include a top view and a partial side cross sectional view showing a cathode substrate mainly illustrating the gate line pattern of a field emission print head according to the present invention.
Figure 3B:
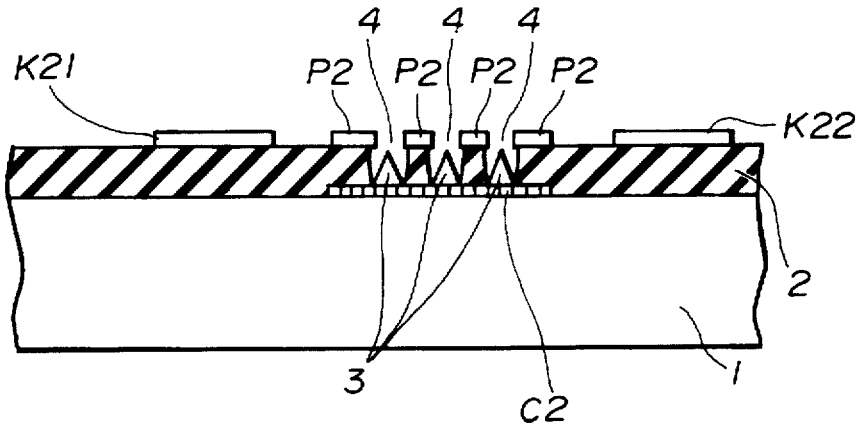

The structure of an embodiment of a field emission print head according to the present invention is shown in FIG. 3. FIG. 3A shows an example of a gate line pattern when a cathode substrate 1 forming the field emission print had according to the present invention is viewed from an upper position. FIG. 3B shows a portion of a cross section of the cathode substrate 1.

As shown in FIG. 3A, a plurality of cathode lines C1, C2, C3, . . . (in the foregoing case only the cathode lines C2 is shown) are formed on the surface of the cathode substrate 1. On the cathode lines C1, C2, C3, . . . . a plurality of cone-shape emitters 3 are formed. Moreover, an insulating layer 2 made of SiO2 and so forth is formed on the cathode substrate 1. The gate line pattern is formed on the insulating layer 2.

As shown in FIG. 3A, the gate line pattern is composed of first gate line GT1, second gate line GT2, patch-like gate electrodes in the form of two lines consisting of an odd number line, consisting of odd-order patch-like gate electrodes P1, P3, P5, . . . and an even number line, consisting of even-order patch-like gate electrode P2, P4, P6, . . . and gate lead lines K11, K12, K13, . . . . K21, K22, K23, . . . respectively connected to the patch-like gate electrodes P1, P2, P3, . . .

The patch-like gate electrodes P1, P2, P3, . . . are provided with openings 4, as shown in FIG. 3B. The leading portions of the emitters 3 formed on the cathode lines face the openings 4.

Cathode lines C1, C3, C5, . . . are formed below the odd-order patch-like gate electrodes P1, P3, P5, . . . to be opposite to the same, the cathode lines C1, C3, C5, . . . being ejected from either side of the cathode substrate 1. On the other hand, cathode lines C2, C4, C6, . . . are formed below the even-order patch-like gate electrodes P2, P4, P6, . . . to be opposite to the same, the cathode lines C2, C4, C6, . . . being ejected from another side of the cathode substrate 1.

Note that the cathode substrate 1 may be made of glass.

Figure 2A:
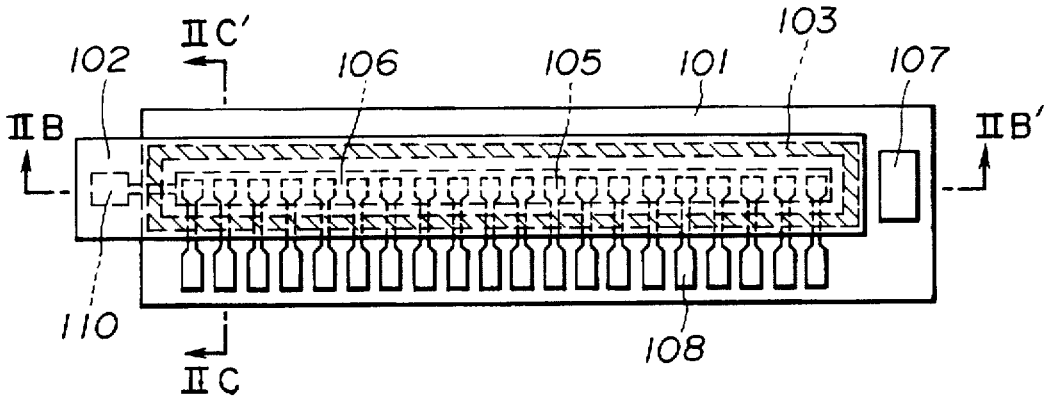
FIG.2A (PRIOR ART)
FIGS. 2(*a*), 2(*b*) and 2(*c*) respectively include a top view, a front cross sectional view and a side cross sectional view showing the schematic structure of the conventional field emission print head.
Figure 2B:
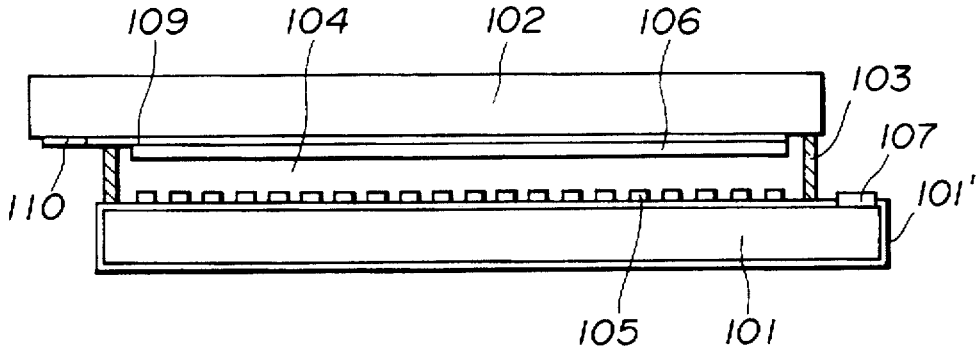
FIG.2B (PRIOR ART)
Figure 2C:
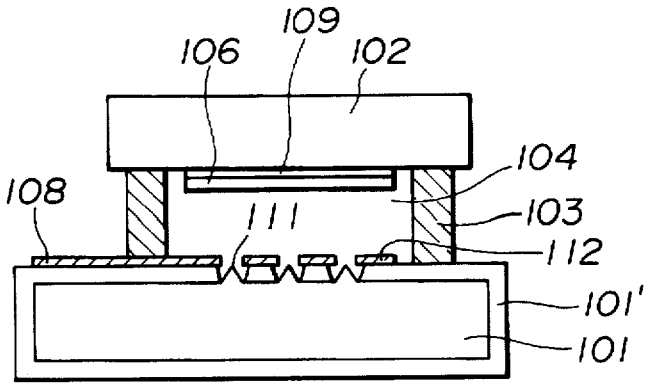
FIG.2C (PRIOR ART)

Although omitted from illustration in FIG. 3 although shown in FIG. 2B, an anode substrate having an anode line formed by patterning a transparent conductive film is disposed opposite to the cathode substrate 1 having the foregoing structure so that the field emission print head is formed.

The field emission print head has a similar shape to that of the structure shown in FIG. 2B. That is, a vacuum airtight container is formed by the cathode substrate 1, the anode substrate and side plates for holding the two substrate to be apart from each other for a predetermined distance. The field emission cathode array and the anode line coated with fluorescent material are accommodated in the vacuum airtight container. Thus, the field emission print head is formed.

The gate line pattern, which is a characteristic of the field emission print head according to the present invention, will now be described. In the present invention, gate lead lines K11, K12, K13, . . . are patterned to surround the odd-order patch-like gate electrodes P1, P3, P5, . . . On the other hand, gate lead lines K21, K22, K23, . . . are patterned to surround the even-order patch-like gate electrodes P2, P4, P6, . . . Moreover, the gate lead lines K11, K12, K13, . . . are patterned to be connected to the second gate line GT2 so as to surround the odd-order patch-like gate electrodes P1, P3, P5, . . . On the other hand, the gate lead lines K21, K22, K23, . . . are patterned to be connected to the first gate line GT1 so as to surround the even-order patch-like gate electrodes P2, P4, P6, . . .

The reason for this will now be described. When the field emission print head according to the present invention is operated, the first gate line GT1 and the second gate line GT2 are alternately selected and operated for each ½ period in a period for displaying one line. An assumption is performed here that the potential of the gate line which is not selected is zero which is the ground level. As a result, the level of each of the gate line, surrounding the patch-like gate electrodes, which is being operated, and the gate lead line is zero. Therefore, electrons field-emitted from the patch-like gate electrodes are affected by the electric field generated from the foregoing lines and, therefore, accelerated by the electric field generated by the anode line, thus resulting in electrons being converged and allowed to reach the anode line.

That is, electrons can be converged and allowed to reach the fluorescent layer which covers the anode line so as to form each pixel to correspond to the patch-like gate electrode. Thus, the fear that adjacent pixels are excited can be eliminated satisfactorily. Thus, generation of leakage emission can be prevented.

By making the level of the gate line, which is not selected and operated, to be a negative level, the foregoing effect can be improved significantly. Note that the foregoing effect can be obtained by simply lowering the level of the gate line when it is not selected.

Figure 4:
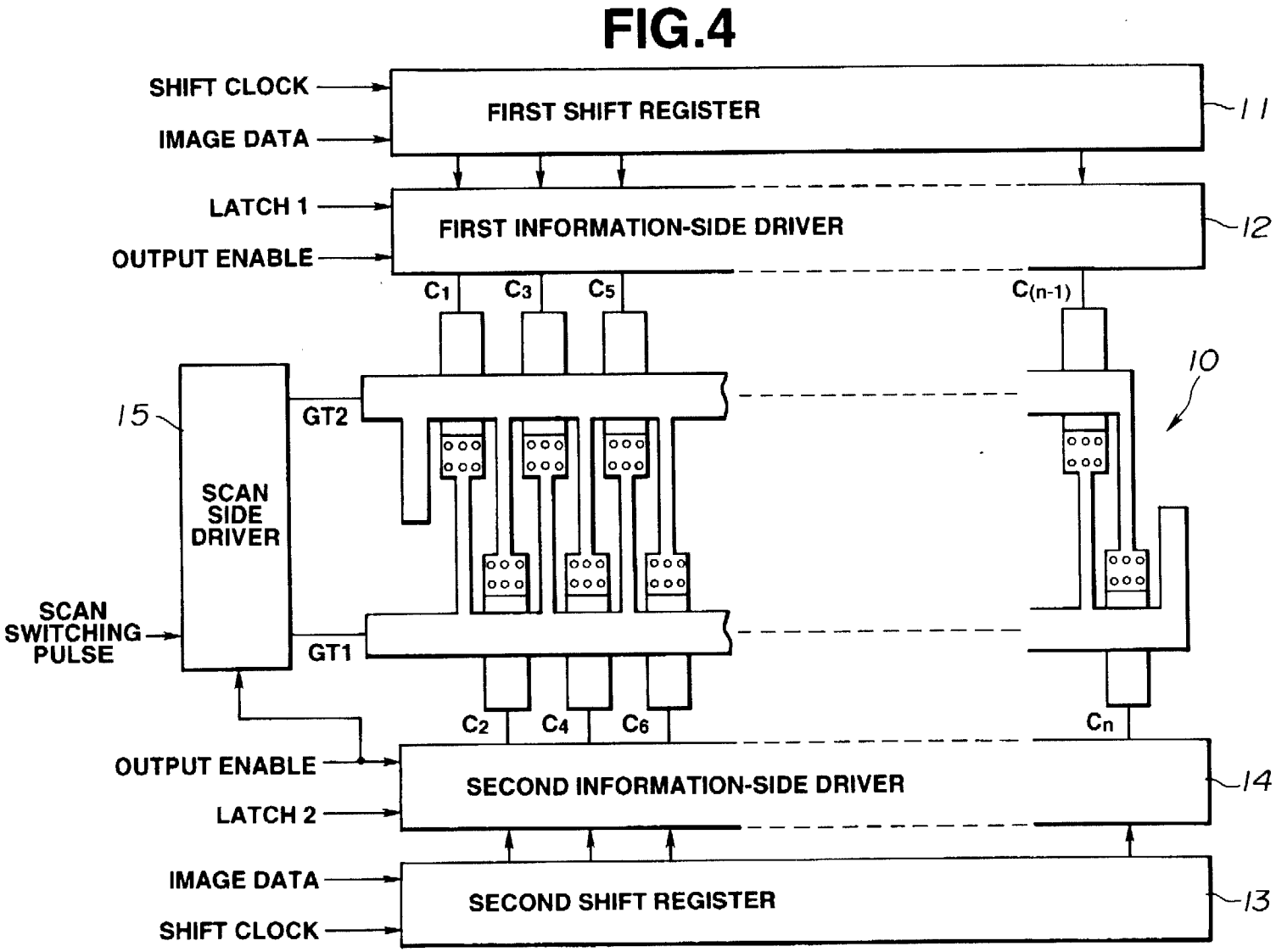
FIG. 4 shows an example of a circuit for operating the field emission print head according to the present invention.

An example of a circuit for operating the field emission print head according to the present invention is shown in FIG. 4.

Referring to FIG. 4, the odd-order cathode lines C1, C3, C5, . . . , C (n−1) of the print head 10 are operated by a first information-side driver 12, while even-order cathode lines C2, C4, C6, . . . , Cn are operated by a second information-side driver 14. The first information-side driver 12 is supplied with serial image data shifted to a first shift register 11 and formed into parallel image data. On the other hand, the second information-side driver 14 is supplied with serial image data shifted to a second shift register 13 and formed into parallel image data.

In the foregoing case, the first shift register 11 is, in a display period for one line, shift-supplied with odd-order image data for one line in response to a shift clock. On the other hand, the first information-side driver 12 is, in a display period for one line, shift-supplied with even-order image data for one line in response to a shift clock. The first information-side driver 12 and the second information-side driver 14 latch odd-order or even-order image data formed into parallel data supplied from the corresponding first shift register 11 and second shift register 13 in response to signal latch-1 and signal latch-2, the generation period of which is the display period for one line.

In the foregoing case, the phases of the signals latch-1 and latch-2 are shifted by p so that the first information-side driver 12 and the second information-side driver 14 use light emission data items, which are alternately made effective in each ½ period of the display period for one line, to operate the corresponding cathode lines. That is, in response to latched odd-order or even-order image data for one line, the first information-side driver 12 and the second information-side driver 14 operate the odd-number cathode lines C1, C3, C5, . . . , C (n−1) or the even number cathode lines C2, C4, C6, . . . , Cn.

The first gate line GT1 and second gate line GT2 of the print head 10 are, by a scan-side driver 15, alternately selected and operated in each ½ period of the display period for one line. The scan-side driver 15 synchronizes with a supplied scan switching pulse to generate a selection drive pulse when an output-enable signal is enable to selectively operate the first gate line GT1 and second gate line GT2.

Thus, image data is used to control light emission from the field emission print head in the line sequential method.

Figure 5:
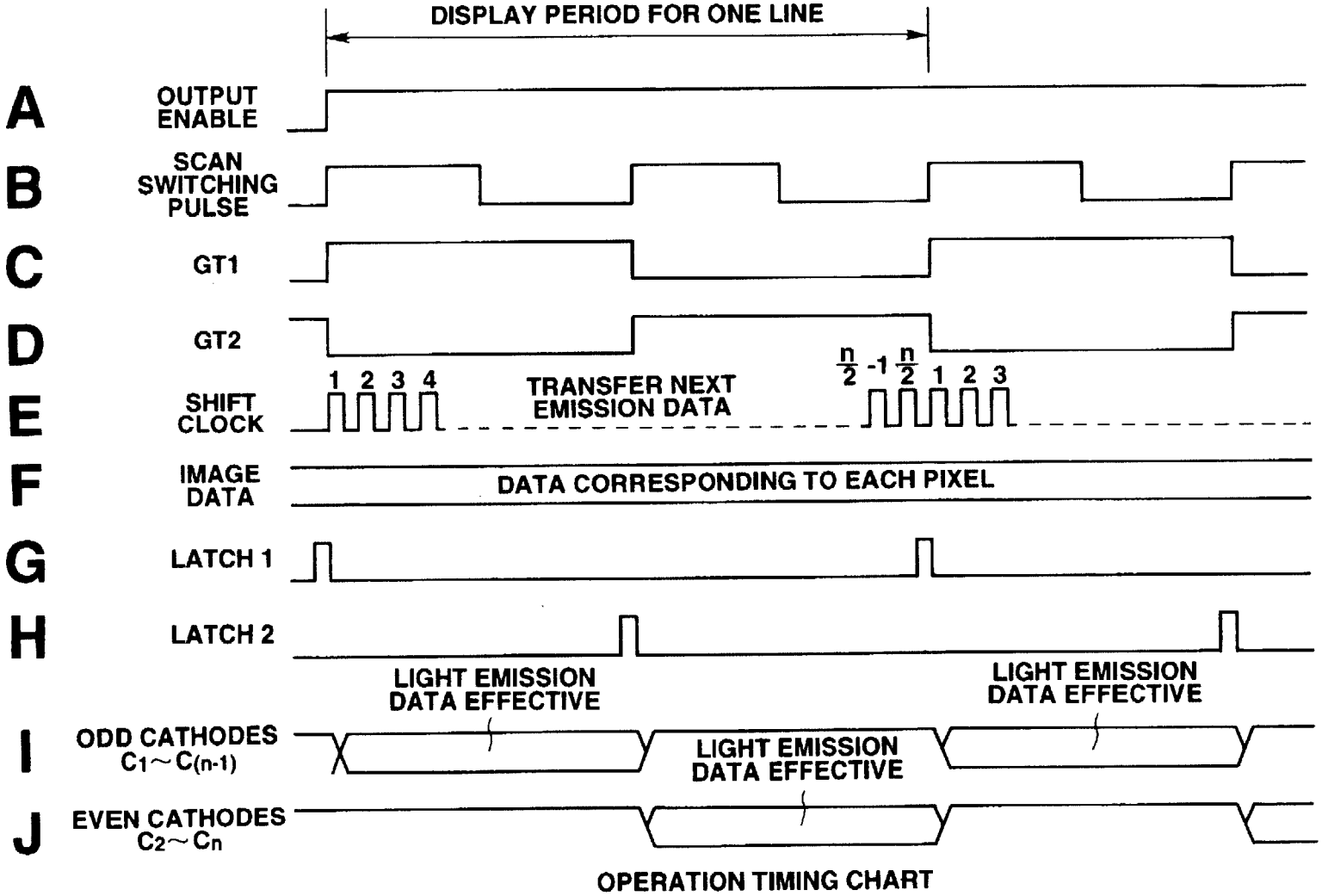
FIG. 5 is a timing chart of the operation of the circuit for operating the field emission print head according to the present invention.

An operation timing chart adapted to an operation circuit for the foregoing field emission print head is shown in FIG. 5.

Portion A of FIG. 5 shows an output enable signal for activating the first information-side driver 12, the second information-side driver 14 and the scan-side driver 15. When the level of the output enable signal is "H", which is the illustrated form, the foregoing circuits are activated. Portion B shows the waveform of a scan switching pulse to be supplied to the scan-side driver 15. The scan-side driver 15 halves the switching pulse to make the generated positive-phase pulse to be an operation signal as shown in portion C for operating the first gate line GT1. The scan-side driver 15 makes the generated negative-phase pulse to be an operation signal as shown in portion D for operating the second gate line GT2.

Portion E of FIG. 5 shows shift clocks to be supplied to the first shift register 11 and the second shift register 13, the number of shift clocks being n/2 in the display period for one line. Note that symbol n indicates the number of pixels for one line.

In response to n/2 shift clocks, every other image data, that is, odd-order or even-order image data for one line shown in portion F of FIG. 5 is, as next light emission data, shifted to the first shift register 11 and the second shift register 13.

Every other image data for one line transferred to the first shift register 11 and the second shift register 13 is latched by the first information-side driver 12 or the second information-side driver 14 in response to the signal latch-1 shown in portion G of FIG. 5 and the signal latch-2 shown in portion H of FIG. 5.

In the foregoing case, since the signal latch-1 and the signal latch-2 are shifted from each other by ½ period (the phase difference is p) in the display period for one line as shown in portions G and H of FIG. 5, image data is alternately latched by the first information-side driver 12 and the second information-side driver 14 in each ½ period of the display period for one line.

Image data to be latched in the foregonig case is made to be the odd-order or even-order image data for one line to be displayed in a period in which the first gate line GT1 or the second gate line GT2 is selected and operated. Therefore, latched image data is effective in alternate every ½ period in the display period for one line as shown in portions I and J of FIG. 5.

That is, the period, in which effective light emission data of the odd cathodes C1, C3, C5, . . . , C (n−1) is supplied, is as shown in portion I of FIG. 6. On the other hand, the period, in which effective light emission data of the even cathodes C2, C4, C6, . . . , Cn is supplied, is as shown in portion J of FIG. 5.

Therefore, light emission from the print head is controlled in accordance with effective light emission data of the odd cathodes C1, C3, C5, . . . , C (n−1) in the first half of the display period for one line. In the latter half, light emission of the print head is controlled by effective light emission data of the even cathodes C2, C4, C6, . . . , Cn so that an image for one line composed of image data for one line is emission-displayed. By sequentially performing the line sequential scan as described above, a light emission display for one frame can be performed by the line sequential method.

Figure 1:
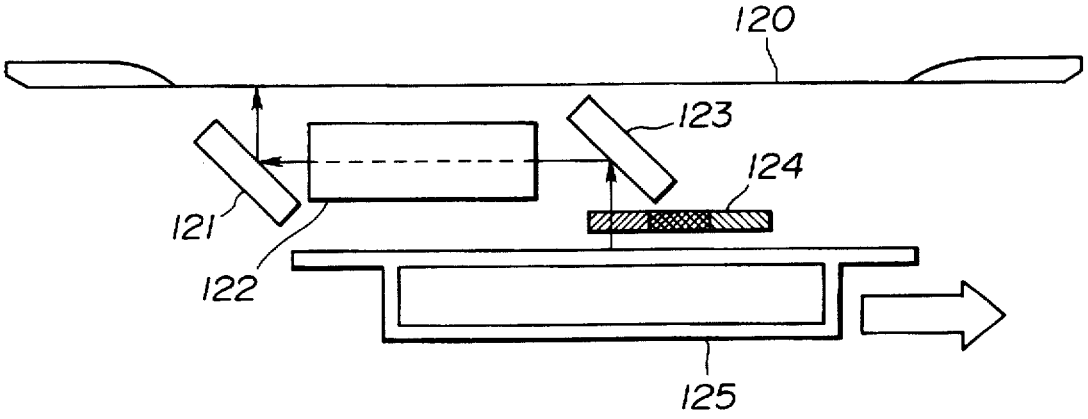
FIG.1 (PRIOR ART)
FIG. 1 is a diagram showing the schematic structure of an optical printer having a conventional field emission print head.

By irradiating an optical recording medium, such as a film, with an optical signal, which is emission-displayed at this time, in the structure shown in FIG. 1, an image for one frame can be printed by an optical method.

Figure 6A:
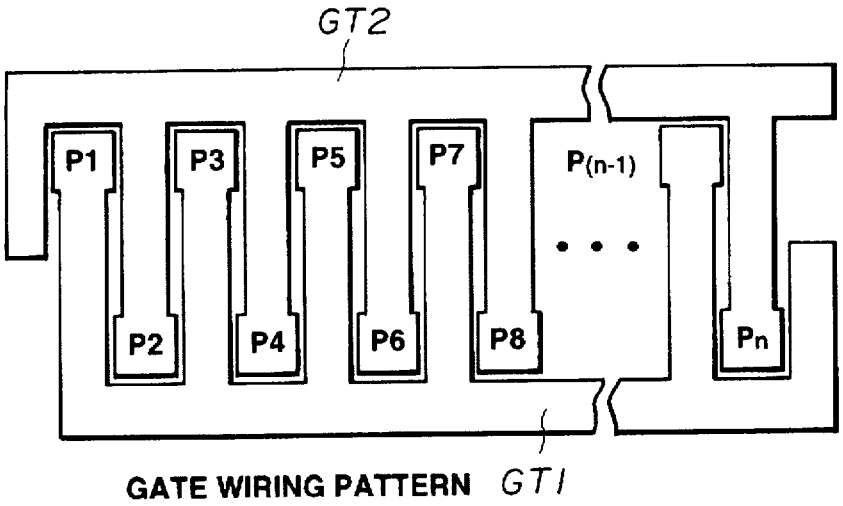
FIGS. 6(*a*) and 6(*b*) are views of explanatory showing an example of an anode line pattern of the field emission print head according to the present invention.
Figure 6B:
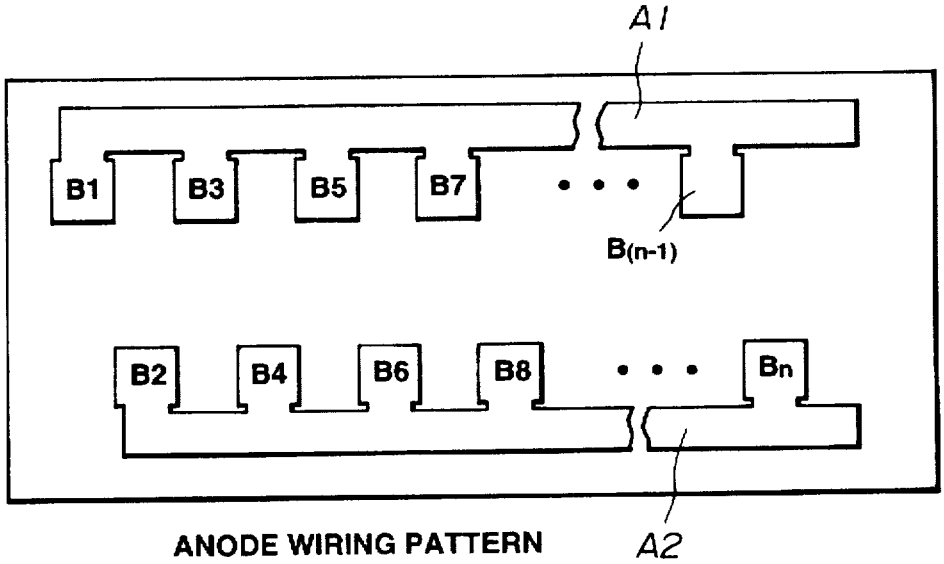

The anode line pattern to be formed on the transparent anode substrate made of, for example, glass will now be described with reference to FIG. 6. The anode line pattern is made of a transparent conductive film made of, ITO or the like, so as to perform irradiation of light emitted from the fluorescent member through the anode and the anode substrate. Since the anode line pattern is formed to correspond to the gate line pattern formed through the anode and the anode substrate. Since the anode line pattern is formed to correspond to the gate line pattern formed on the cathode substrate, the gate line pattern shown in FIG. 1 is shown in FIG. 6A. The anode line pattern corresponding to the foregoing gate line pattern is shown in FIG. 6B. As shown in FIG. 6, the anode line pattern is composed of first anode line A1, second anode line A2, a line consisting of odd-order patch-like anode electrodes B1, B3, B5, . . . , B (n−1) opposite to the odd-order patch-like gate electrodes P1, P3, P5, . . . , P (n−1) and a line consisting of even-order patch-like anode electrodes B2, B4, B6, . . . , Bn opposite to the even-order patch-like gate electrodes P2, P4, P6, . . . , Pn.

The odd-order patch-like anode electrodes B1, B3, B5, . . . , B (n−1) are connected to the first anode line A1, while the even-order patch-like anode electrodes B2, B4, B6, . . ., Bn are connected to the second anode line A2.

The trajectory of the electrons emitted from, for example, the patch-like gate electrode P1, is bent to be directed to the gate lead line by the electric field generated by the gate lead line because the potential of the gate lead line of the patch-like gate electrode P1 is positive. Thus, the emitted electrons are distributed in the form of an ellipse. If the distribution of discharged electrons is in the form of the ellipse, a portion of the discharged electrons does not effectively reach the fluorescent layer covering the patch-like anode electrode B1. As a result, the quantity of light will be reduced.

To prevent this, the patch-like anode electrode B1 is connected to the first anode line A1 to introduce the electrons into a direction opposite to the direction of the gate lead line.

When the field emission print head is operated, the first anode line A1 opposite to the first gate line GT1 is selectively operated when the first gate line GT1 is being selected and operated. When the second gate line GT2 is being selected and operated, the opposite second anode line A2 is selectively operated. In the foregoing case, the level of the anode line pattern, which is not selected and operated is made to be a low level (may be zero or a negative level). As a result, electrons emitted from the patch-like gate electrodes, which are being selected and operated, are further converged when reaching the anode line pattern. Thus, leakage emission of adjacent pixels can further be prevented.

In the anode line pattern shown in FIG. 6B, the odd-order patch-like anode electrodes B1, B3, B5, . . . , B (n−1) and the even-order patch-like anode electrodes B2, B4, B6, . . . , Bn are apart from one another by a distance corresponding to, for example, three lines. The foregoing distance is determined to be the distance corresponding to the three lines in consideration of the delay of the latter half emission-displayed image by the ½ period of the display period for one line. Thus, image data to be supplied to the second shift register 13 is delayed by three lines with respect to image data to be supplied to the first shift register 11.

Although the foregoing description has been performed about the structure in which the anode line pattern has two anode lines which are alternately selected and operated, the anode line pattern may be formed into a flat and solid plane because emitted electrons can be converged only by the gate line pattern.

As described above, the present invention has the structure such that each of the gate lead lines connected to any one of two lines of the patch-like gate electrodes is connected to either of two gate lines alternately drawn from portions between every other patch-like gate electrode. In the foregoing case, the two gate lines are alternately selected and operated. By making the potential of the gate line, which is not being selected and operated, to be a low level (may be zero level or a negative level), electrons, which are field-emitted from each patch-like gate electrode, do not diffuse but converge. In the foregoing case, the structure such that the patch-like gate electrodes are surrounded by the gate lead lines for the other lines will improve the obtainable advantage.

When two anode lines are provided to correspond to the two gate lines and the potential of the anode lines of the lines opposite to the gate lines, which are not being selected and operated, are made to be a low level (may be zero level or a negative level), electrons can further be converged.

Therefore, leakage emission of adjacent pixels can further be prevented so that a high quality printed image is obtained.

Since the electric field generated from the non-selected gate line acts to eliminate the influence of the state of selection of other pixels positioned in the vicinity of the selected pixel, an undesirable change in the light quantity can be prevented regardless of the state where the adjacent pixels are turned on.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A field emission print head comprising:

a plurality of cathode lines formed on a cathode substrate;

a plurality of emitters formed on said cathode lines;

a plurality of gate electrodes formed on said cathode substrate though an insulating layer at positions opposite to said cathode lines, said gate electrodes being disposed adjacent to leading ends of said plural emitters;

a first gate line connected to a first set of the plurality of gate electrodes by a first set of respective gate lead lines;

a second gate line connected to a second set of the plurality of gate electrodes by a second set of respective gate lead lines;

wherein the first set of respective gate lead lines are patterned to surround the second set of the plurality of gate electrodes and the second set of respective gate lines are patterned to surround the first set of the plurality of gate electrodes ;and wherein the first and second gate line are alternately selected for one-half of a period for displaying one line, and said non-selected first or second gate line receives a lower potential than a selected of the first and second gate lines.

2. A field emission print head according to claim 1, wherein the non-selected of the first and second gate line receives a ground potential as the lower potential.

3. A field emission print head according to claim 1, wherein the non-selected of the first and second gate line receives a negative potential as the lower potential.

4. A field emission print head according to claim 1, wherein said first set of the plurality of gate electrodes is of an odd-order and said second set of the plurality of gate electrodes is of an even-order.

5. A field emission print head according to claim 1, further comprising:

an anode substrate disposed opposite to said cathode substrate and including an anode line pattern having a fluorescent layer applied to portions opposite to said plurality of gate electrodes.

6. A field emission print head according to claim 1, wherein said anode line pattern has two lines of anode electrodes formed opposite to said first and second set of gate lead lines and two anode lines to each of which said two lines of anode electrodes are connected, said two lines of anode electrodes being covered with said fluorescent layer anode.

7. A field emission print head according to claim 1, wherein said anode line pattern has anode electrodes formed substantially in a straight line being opposite to said first and second set of gate lead lines and two anode lines to which every other anode electrode is connected, and said fluorescent layer covering said anode electrodes formed in a straight line displays one line of display data.

* * * * *

UNITED STATES PATENT AND TRADEMARK OFFICE

CERTIFICATE OF CORRECTION

PATENT NO. : 5,760,810

DATED : June 2, 1998

INVENTOR(S) : Koji ONODAKA

It is certified that error appears in the above-identified patent and that said Letters Patent is hereby corrected as shown below:

On the title page, Item [30], the Foreign Application Priority Data has been omitted. It should read:

--Jun. 9, 1995 [JP] Japan.....07-167148--

Signed and Sealed this

Ninth Day of March, 1999

*Attest:*

Q. TODD DICKINSON

*Attesting Officer*

*Acting Commissioner of Patents and Trademarks*